US005180111A

United States Patent [19]

Hart

[11] Patent Number: 5,180,111

[45] Date of Patent: Jan. 19, 1993

[54] CONTROLLED FLOW DISPENSING UNIT

[75] Inventor: Thomas G. Hart, North Brunswick, N.J.

[73] Assignee: American Standard Inc., New York, N.Y.

[21] Appl. No.: 900,763

[22] Filed: Jun. 19, 1992

Related U.S. Application Data

[63] Continuation of Ser. No. 598,905, Oct. 16, 1990, abandoned.

[51] Int. Cl.[5] ..... B05B 1/22

[52] U.S. Cl. ..... 239/590

[58] Field of Search ..... 239/193, 194, 590, 590.3, 239/590.5, 597

[56] References Cited

U.S. PATENT DOCUMENTS

| | | | |
|---|---|---|---|
| 651,162 | 6/1900 | Dietrich | 239/590.3 X |
| 1,398,941 | 11/1921 | Gable | 239/590.3 X |
| 3,632,049 | 1/1972 | Winters | 239/590 |
| 4,886,210 | 12/1989 | Gaffney et al. | 239/193 |

FOREIGN PATENT DOCUMENTS

| | | | |
|---|---|---|---|
| 2641802 | 3/1978 | Fed. Rep. of Germany | 239/193 |
| 293636 | 12/1953 | Switzerland | 239/590 |

*Primary Examiner*—Andres Kashnikow
*Assistant Examiner*—Kevin P. Weldon
*Attorney, Agent, or Firm*—Blum Kaplan

[57] ABSTRACT

The present invention comprises a water spout for a sink, bathtub or the like, for providing a sheet-like flow of water. The spout has an inlet with a central longitudinal axis and an inlet cover disposed within the spout for directing inflowing water away from the central longitudinal axis into a first chamber. The top of the first chamber is defined, at least in part, by a substantially horizontal baffle which preferably extends from the front of the spout to a point proximate the rear wall of the spout leaving a gap between the rearward edge of the baffle and the rear wall of the spout. A second chamber, preferably having a volume greater than the volume of the first chamber, is disposed above the substantially horizontal baffle. The water exits the spout through a mouth which is fluidic communication with the second chamber. The mouth is most preferably in fluidic communication with a forward position of the second chamber at a point higher than the rearward edge of the baffle. In this manner, water must, at least initially, flow upwardly in the second chamber before exiting the mouth of the spout.

8 Claims, 4 Drawing Sheets

CONTROLLED FLOW DISPENSING UNIT

This is a continuation of U.S. patent application Ser. No. 07/598,905, filed on Oct. 16, 1990, now abandoned.

The present invention is directed to a fluid dispensing unit, and more particularly, to a unit for dispensing a fluid in a sheet-like flow.

BACKGROUND OF THE INVENTION

Man has attempted to control the flow of fluids from dispensing units for many centuries. From the fountains in ancient Greece to the wide variety of industrial fluid applications which require precise fluid flow, engineers have worked for greater fluid control. To this end, scientists have realized that careful attention must be given, not only to the actual point of egress of the fluid from the dispensing unit, but also the flow of the fluid within the unit upstream of that point of egress.

A common concern among engineers is to design a dispensing unit which is able to receive a turbulent ingress of fluid from a high pressure source and bring that turbulent flow under control in order to obtain a desired fluid flow at the point of egress from the dispensing unit.

A dispensing unit should therefore be designed to provide the necessary fluid control for delivering the fluid from a fluid inlet to the point of egress.

Previously known fluid dispensing units designed to provide a sheet-like flow of fluid have appreciated the need for controlling the flow of fluid upstream of the point of fluid egress from the unit. Such devices have been provided with chambers proximate the point of fluid ingress into the dispensing unit. While the inflowing water is in a chamber adjacent the inlet to the unit, this fluid is subject to direct contact with other fluid flowing into this chamber. Therefore, the fluid in the unit is less controllable and more likely to maintain a turbulent flow pattern than if it was transferred to another chamber substantially separated from the inlet.

It would, therefore, be desirable to provide a fluid dispensing unit for dispensing a sheet-like fluid flow wherein the fluid spends a substantial amount of time in an area away from the direct influence of the turbulent flow of the inlet.

SUMMARY OF THE INVENTION

The present invention comprises a water spout for a sink, bathtub or the like, for providing a sheet-like flow of water. The spout has an inlet with a central longitudinal axis and an inlet cover disposed within the spout for directing inflowing water away from the central longitudinal axis into a first chamber. The top of the first chamber is defined, at least in part, by a substantially horizontal baffle which preferably extends from the front of the spout to a point proximate the rear wall of the spout leaving a gap between the rearward edge of the baffle and the rear wall of the spout. A second chamber, preferably having a volume greater than the volume of the first chamber, is disposed above the substantially horizontal baffle. The water exits the spout through a mouth which is in fluidic communication with the second chamber. The mouth is most preferably in fluidic communication with a forward position of the second chamber at a point higher than the rearward edge of the baffle. In this manner, water must, at least initially, flow upwardly in the second chamber before exiting the mouth of the spout.

DETAILED DESCRIPTION OF THE DRAWINGS

Figure 1:
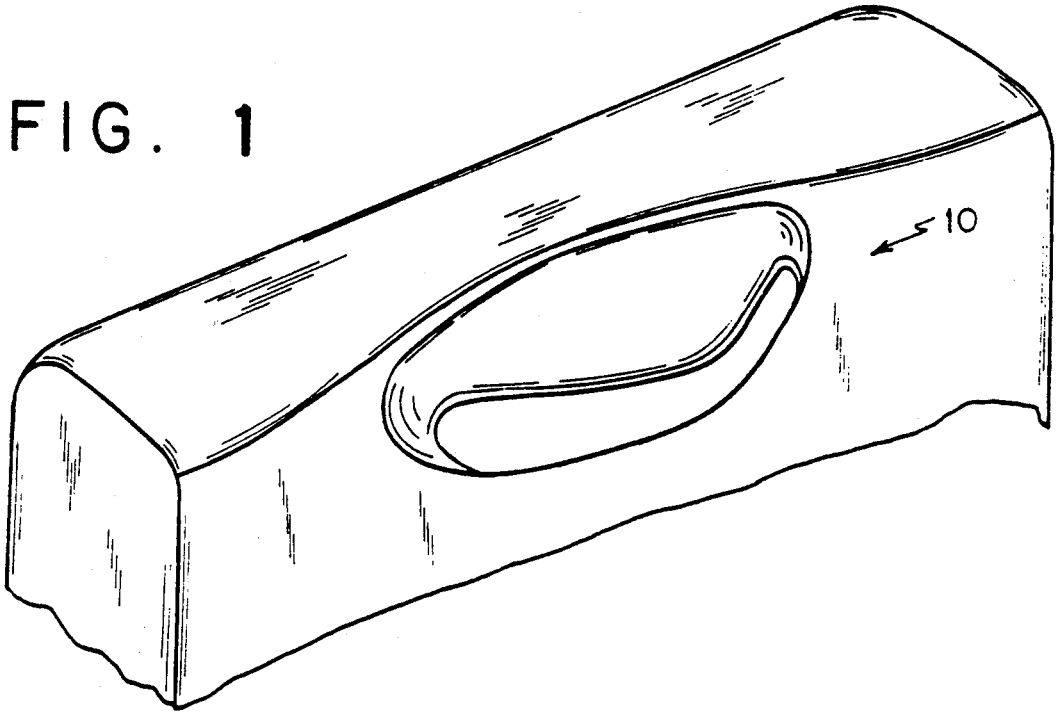
FIG. 1 is a perspective view of one embodiment of the present invention mounted on the side of a tub which is illustrated in phantom.
Figure 2:
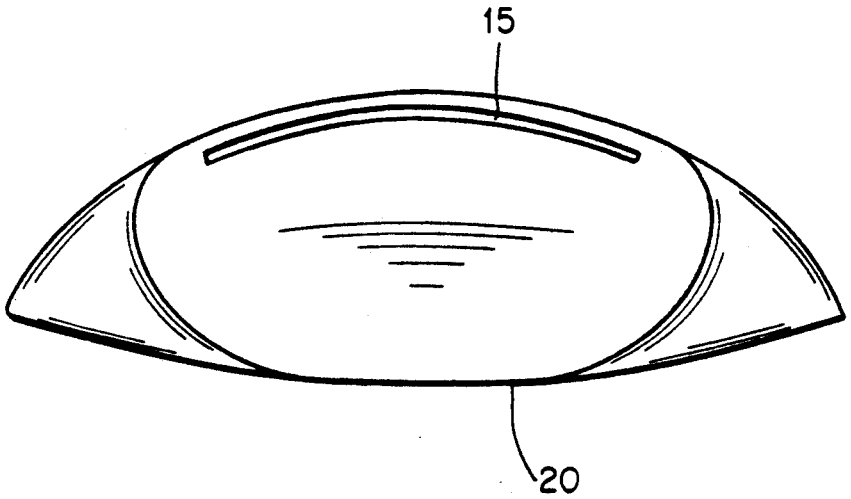
FIG. 2 is a bottom view of the spout illustrated in FIG. 1.

As illustrated in FIG. 1, the present invention comprises a water spout 10 for creating a sheet-like water flow. The present invention is particularly adapted to be mounted on the side wall of a bathtub, sink or the like. While the preferred embodiment of the present invention has an elongated, arcuate mouth positioned at the forward end 12 of the spout, as shown in FIG. 2, the outside configuration of the spout of the present invention is not limited to the configurations illustrated in the figures.

Figure 3:
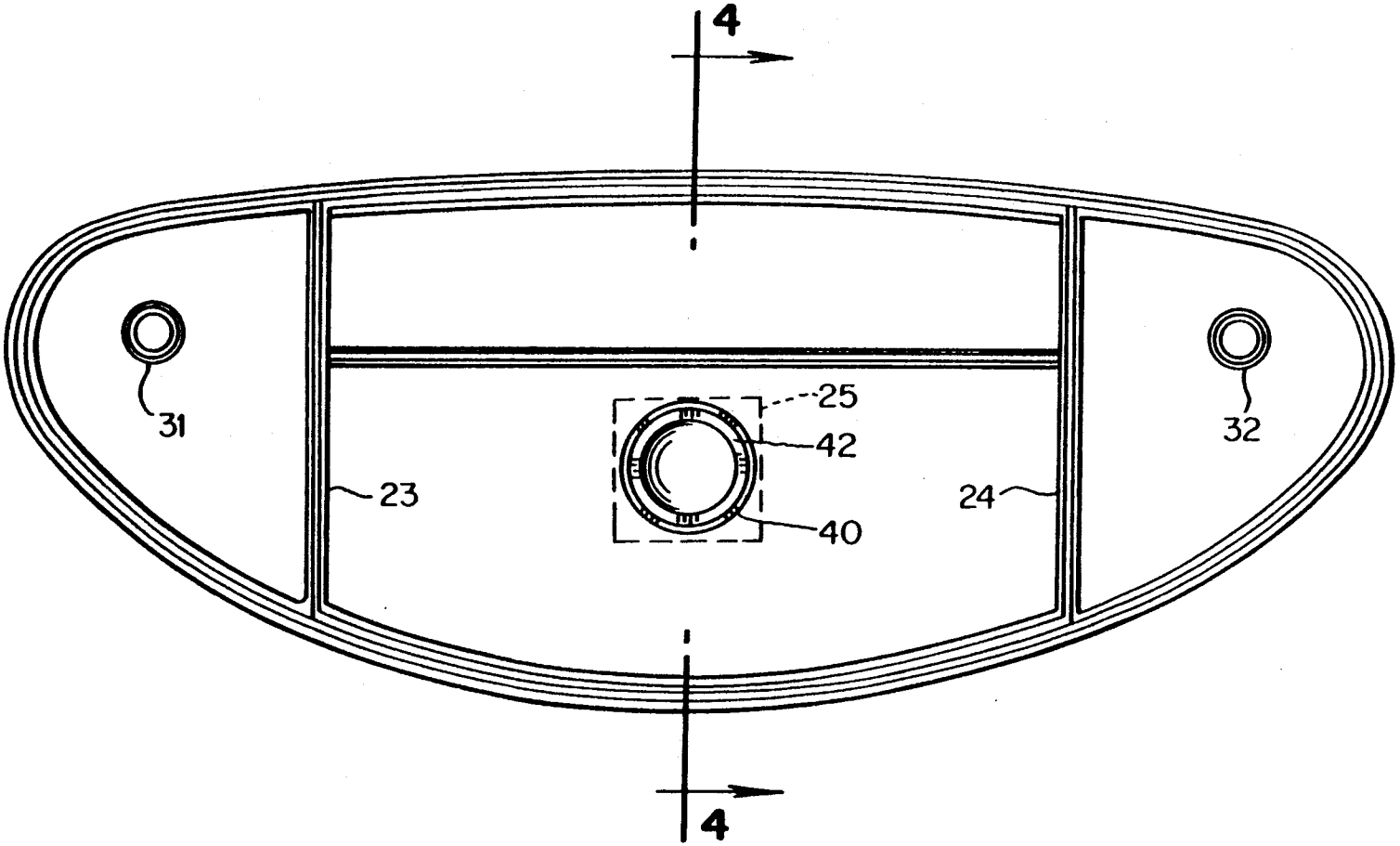
FIG. 3 is a rear view of the spout illustrated in FIG. 1.

As illustrated in FIG. 3, the rear wall of spout 10 is preferably provided with mounting holes 31 and 32 to allow easy mounting of spout 10 on a bathroom fixture or the like. According to the illustrated embodiment of the present invention, inlet 40 is centrally positioned on the rear wall 20. Inlet 40 is preferably provided with an O-ring 42 for facilitating a water type connection between inlet 40 and a water pipe (not shown). A pair of side walls 23, 24 are disposed to the sides of inlet 40. In the illustrated preferred embodiment of the present invention, side walls 23, 24 prevent water from flowing into the area adjacent mounting holes 31, 32 to minimize the risk of leaks.

Figure 4:
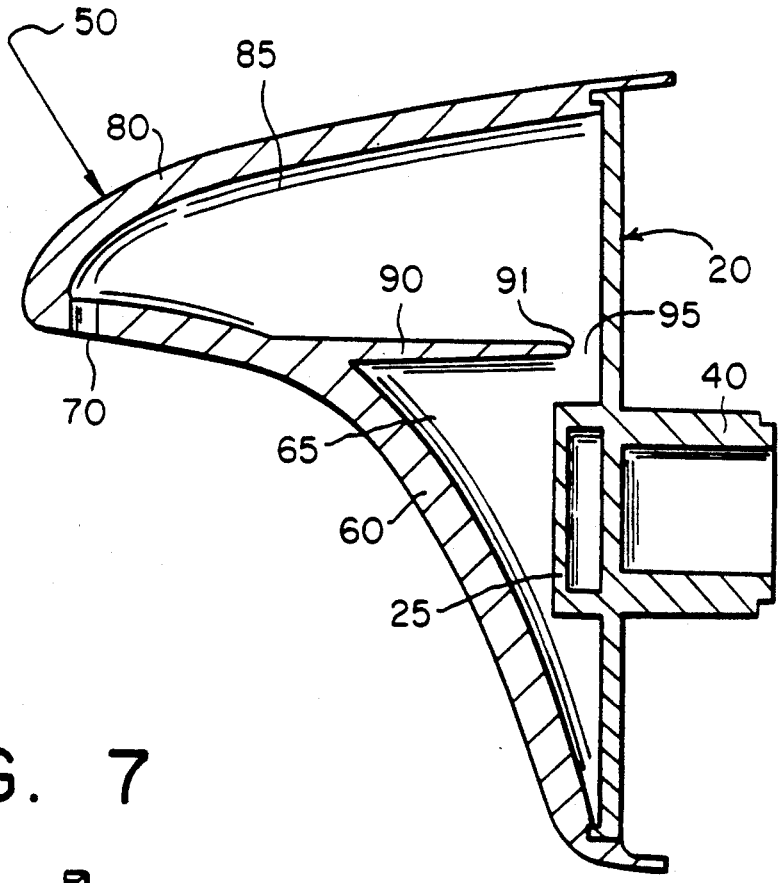
FIG. 4 is a cross-sectional view taken along lines 4—4 of the FIG. 3.

The operative, fluid directing elements of spout 10 are best illustrated in FIG. 4 which illustrates back wall 20, top wall 50 and front wall 60. According to this preferred embodiment of the present invention, spout 10 is formed of two separately molded elements, namely rear wall 20 and forward spout cover 50. Back wall 20 and spout cover 50 may be formed of any suitable material, for example, plastic. Spout cover 50 is joined with rear wall 20 in a fluid type fashion such as by known water-tight adhesives.

In the illustrated embodiment, rear wall 20 is molded integrally with inlet cover 25. Spout cover 50 comprises a forward wall 60, mouth 70, upper wall 80 and an interior baffle 90. Spout cover 50 is attached to rear wall 20 such that baffle 90 is positioned substantially horizontally and at a location higher than fluid inlet 40. A first chamber 65 is defined at its upper limit by the bottom surface of baffle 90, and the portions of forward wall 60 and rear wall 20 disposed below the bottom surface of baffle 90. Baffle 90 is substantially parallel to the longitudinal axis L—L of inlet 40. When water enters inlet 40 it would normally flow generally in a direction along longitudinal axis L-L until striking inlet cover 25. Upon impacting inlet cover 25, the inflowing water is diverted laterally toward side walls 23, 24 and into first chamber 65. This lateral diversion of inflowing water enhances the even distribution of water in first chamber 65.

As illustrated in FIG. 4, rearward edge 91 of baffle 90 forms a gap 95 with the rear wall 20. Gap 95 is the only place where water flows from first chamber 65 into second chamber 85. According to this preferred embodiment of the present invention, the volume of second chamber 85 is greater than the volume of first chamber 65. The ratio of the volume of first chamber 65 to second chamber 85 is preferably about 1:1.25–1:5, most preferably about 1:2. In this manner, the water spends a greater time in second chamber 85 away from the turbulent effects of inlet 40.

In controlling the flow of water from first chamber 65 to second chamber 85 due consideration is given to the size of gap 95. Gap 95 is preferably about 1/16 to ¾ inch and most preferably about ⅛ inch.

The illustrated preferred embodiment of the present invention is also advantageously provided with an incline disposed between mouth 70 and rear edge 91 of baffle 90, in second chamber 85. With the illustrated design, water is not permitted to simply pour over rear edge 91 and out mouth 70 but is forced to spend at least some time in second chamber 85. By positioning mouth 70 above rearward edge 91, water must remain within upper chamber 85 for at least some time facilitating the decrease in any turbulence occurring in the second chamber 85.

Figure 7:
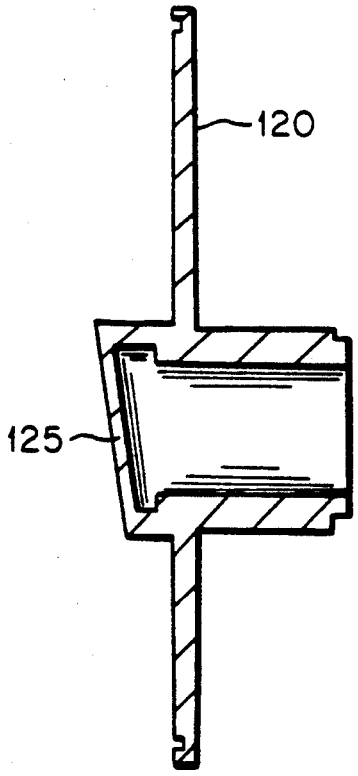
FIG. 7 is a cross-sectional side view taken along line 7—7 of FIG. 5.
Figure 5:
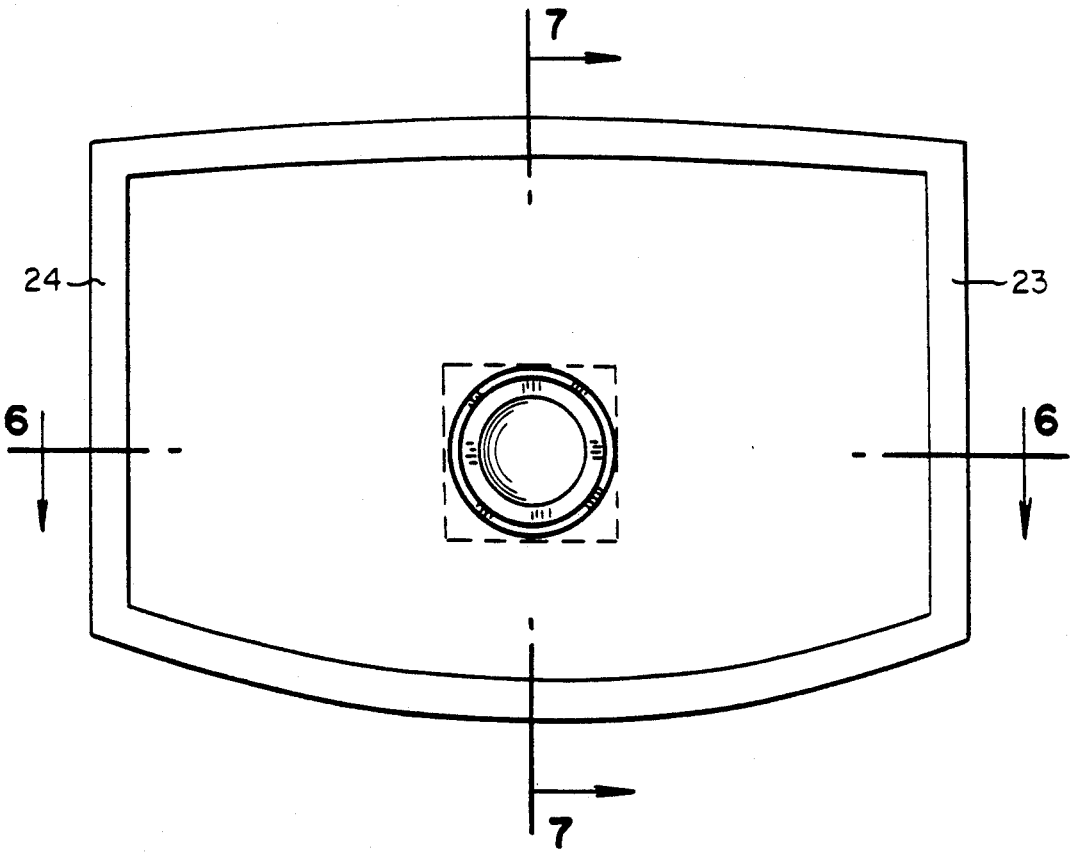
FIG. 5 is a front view of an alternative embodiment of the present invention.
Figure 6:
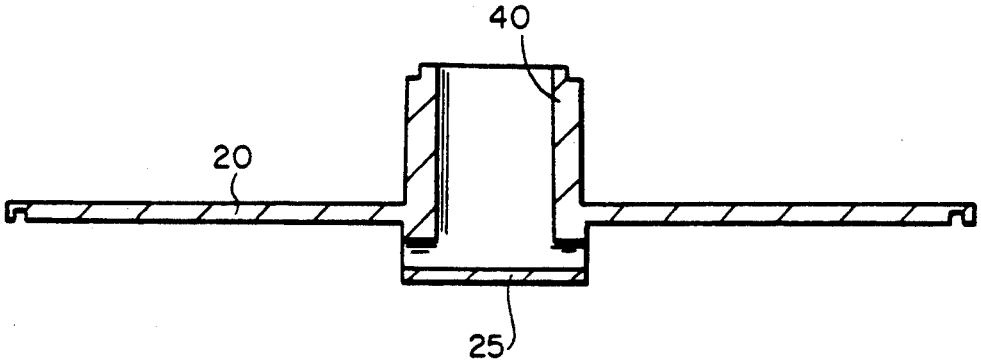
FIG. 6 is a top view taken along line 6-6 of FIG. 5.

An alternative embodiment of the back wall 120 and inlet cover 125 are illustrated in FIGS. 5–7. According to this embodiment of the present invention, the inlet cover 125 is disposed on an angle relative to back wall 120. According to this embodiment of the present invention, inflowing water is not only directed laterally toward the side walls of the first chamber but also somewhat vertically. Those skilled in the art will appreciate that the turbulence in the first chamber may be minimized by directing the inflowing water either upwardly or downwardly with the inlet cover, depending upon the configuration of the first chamber.

What is claimed is:

1. A water spout for creating a sheet-like water flow comprising:

a rear wall, a spout cover coupled to said rear wall, said spout cover having a top wall and a forward wall;

a substantially planar baffle extending substantially horizontally from said forward wall to a position proximate said rear wall and terminating in a rear edge thereby forming a gap between said rear wall and said rear edge, said rear edge of said baffle being substantially flat in cross-section;

a first fluid chamber defined at least in part by said rear wall and a bottom side of said baffle;

a second fluid chamber defined at least in part by said rear wall and a top side of said baffle, said second chamber having a volume larger than the volume of said first chamber, said second chamber including a surface on said forward wall which slopes upwardly in the direction of water flow from said gap;

an inlet having an opening in said first chamber and a central longitudinal axis extending towards said forward wall;

an inlet cover positioned proximate said inlet for diverting inflowing water away from said longitudinal axis in a lateral direction into said first chamber; and a downwardly facing elongated outlet in said forward wall open to said second chamber for directing water out of said second chamber, said outlet disposed at a position higher than said rear edge of said baffle.

2. A water spout according to claim 1 wherein the ratio of the volume of said first chamber to the volume of said second chamber is about 1:1.25–1:5.

3. A water spout according to claim 2 wherein the ratio of the volume of said first chamber to the volume of said second chamber is about 1:2.

4. A water spout according to claim 1 wherein said gap is about 1/16–¾ inches.

5. A water spout according to claim 1 wherein said gap is about ⅛ inch.

6. A water spout according to claim 1 wherein said inlet cover is integrally molded with said rear wall.

7. A water spout according to claim 1 wherein said baffle is integrally molded with said spout cover.

8. A water spout according to claim 1 wherein said spout is formed from a plastic material.

* * * * *